US007677062B2

(12) United States Patent
Zaccone et al.

(10) Patent No.: US 7,677,062 B2
(45) Date of Patent: Mar. 16, 2010

(54) WASHING MACHINE WITH SPRAYING DEVICE

(75) Inventors: Mark A. Zaccone, Louisville, KY (US); Paul Michael Hoppe, Louisville, KY (US)

(73) Assignee: General Electric Company, Schenectady, NY (US)

( * ) Notice: Subject to any disclaimer, the term of this patent is extended or adjusted under 35 U.S.C. 154(b) by 709 days.

(21) Appl. No.: 11/257,657

(22) Filed: Oct. 25, 2005

(65) Prior Publication Data

US 2007/0107471 A1 May 17, 2007

(51) Int. Cl.
*D06F 29/00* (2006.01)

(52) U.S. Cl. ..... 68/23.5; 68/207

(58) Field of Classification Search ..... 68/23.5, 68/23 A, 207

See application file for complete search history.

(56) References Cited

U.S. PATENT DOCUMENTS

| | | | | |
|---|---|---|---|---|
| 2,480,921 | A * | 9/1949 | Hahn | 68/148 |
| 3,461,791 | A * | 8/1969 | Beyer | 454/155 |
| 3,620,053 | A | 11/1971 | Dunn | |
| 4,225,992 | A | 10/1980 | Morey | |
| 4,432,111 | A | 2/1984 | Hoffmann et al. | |
| 4,464,914 | A | 8/1984 | Torita | |
| 4,809,524 | A | 3/1989 | Sickert et al. | |
| 4,810,306 | A | 3/1989 | Noren | |
| 4,872,466 | A | 10/1989 | Noren | |
| 5,167,722 | A | 12/1992 | Pastryk et al. | |
| 5,191,668 | A | 3/1993 | Euler et al. | |
| 5,199,127 | A | 4/1993 | Van Newenhizen et al. | |
| 5,233,718 | A | 8/1993 | Hardaway et al. | |
| 5,504,955 | A | 4/1996 | Mueller et al. | |
| 5,606,877 | A | 3/1997 | Hashimoto | |
| 5,657,650 | A * | 8/1997 | Lee et al. | 68/23.5 |
| 5,687,440 | A | 11/1997 | Min et al. | |
| 5,743,115 | A | 4/1998 | Hashimoto | |
| 5,758,377 | A | 6/1998 | Cimetta et al. | |
| 5,768,730 | A | 6/1998 | Matsumoto et al. | |
| 5,937,677 | A * | 8/1999 | Lee | 68/23.5 |
| 6,029,298 | A | 2/2000 | Dausch et al. | |
| 6,351,974 | B1 * | 3/2002 | Lyu et al. | 68/148 |
| 6,668,410 | B2 * | 12/2003 | Lyu et al. | 8/158 |
| 7,010,942 | B2 * | 3/2006 | Ryu et al. | 68/19 |
| 7,263,862 | B2 * | 9/2007 | Lyu et al. | 68/23.3 |
| 7,263,864 | B2 * | 9/2007 | Lyu et al. | 68/148 |
| 2005/0273945 | A1 * | 12/2005 | Zaccone et al. | 8/159 |

* cited by examiner

*Primary Examiner*—Joseph L Perrin
(74) *Attorney, Agent, or Firm*—George L. Rideout, Esq.; Armstrong Teasdale LLP

(57) ABSTRACT

A spraying device for a washing machine includes a body including a wall having an outer surface, a water inlet and a channel defined therein. The channel is in flow communication with the water inlet, and a plurality of nozzles extend through the wall and in flow communication with the channel. The washing machine includes a wash tub and a basket mounted within the wash tub. The basket is configured to rotate. The nozzles include an inlet, an outlet, an inner diameter, and an outer diameter. At least a portion of the outlet includes a surface substantially perpendicular to a flow of water through the nozzle, and the nozzles have a length longer than a thickness of the wall. At least a portion of the outlet is unitary with the wall outer surface.

12 Claims, 12 Drawing Sheets

WASHING MACHINE WITH SPRAYING DEVICE

BACKGROUND OF THE INVENTION

This invention relates generally to washing machines, and, more particularly, to methods and apparatus for reducing water consumption in washing operations.

Washing machines typically include a cabinet that houses an outer tub for containing wash and rinse water, a perforated laundry basket within the tub, and an agitator within the basket. A drive and motor assembly is mounted underneath the stationary outer tub to rotate the laundry basket and the agitator relative to one another, and a pump assembly pumps water from the tub to a drain to execute a wash cycle.

Traditionally, rinse portions of wash cycles include a deep-fill process wherein articles in the laundry basket are completely submerged in water and the water is agitated. As such, a large amount of water mixes with detergent remaining in the laundry after they are washed. While the concentration of detergent in the water is relatively small, a large amount of detergent can be removed from the laundry due to the large amount of water involved. It has become increasingly desirable, however, to reduce water consumption in washing operations.

At least some types of washing machines have reduced water consumption in rinsing operations by using a re-circulating rinse water flow. In this type of system, rinse water is collected in a bottom of the tub and pumped back to a plurality of spray nozzles located above the basket. The rinse water is re-circulated for a predetermined length of time before being discharged to a drain. While such systems are effective to reduce water consumption, they increase the costs of a washing machine by employing pumps, conduits etc. that result in additional material and assembly costs.

BRIEF DESCRIPTION OF THE INVENTION

In one aspect, a spraying device for a washing machine is provided. The washing machine includes a wash tub and a basket mounted within the wash tub, the basket configured to rotate. The spraying device includes a body including a wall having an outer surface, a water inlet and a channel defined therein. The channel is in flow communication with the water inlet, and a plurality of nozzles extend through the wall and are in flow communication with the channel. The nozzles include an inlet, an outlet, an inner diameter, and an outer diameter. At least a portion of the outlet includes a surface substantially perpendicular to a flow of water through the nozzle. The nozzles have a length longer than a thickness of the wall, and at least a portion of the outlet is unitary with the wall outer surface.

In another aspect, a spraying device for a washing machine is provided that includes a body including a wall having an outer surface, a water inlet and a channel defined therein. The channel is in flow communication with the water inlet, and a plurality of nozzles extend through the wall and are in flow communication with the channel. Each nozzle includes an inlet, an outlet, and a channel extending therebetween. At least a portion of the outlet includes a surface substantially perpendicular to a flow of water through the nozzle. The nozzles have a length longer than a thickness of the wall and at least a portion of each nozzle is recessed with respect to the outer surface of the wall.

In another aspect, a washing machine is provided that includes a cabinet, a wash tub positioned within the cabinet, a basket rotatably mounted within the wash tub, and a spraying device positioned within the cabinet and above the wash tub. The spraying device includes a body including a wall having an outer surface, a water inlet and a channel defined therein. The channel is in flow communication with the water inlet, and a plurality of nozzles extend through the wall and are in flow communication with the channel. Each nozzle includes an inlet, an outlet, an inner diameter and an outer diameter. At least a portion of the outlet includes a surface substantially perpendicular to a flow of water through the nozzle. At least a portion of the outer diameter of the outlet is positioned within an area defined by the wall outer surface.

In another aspect, a method of manufacturing a washing machine is provided. The washing machine includes a cabinet, a wash tub positioned within the cabinet, a basket rotatably mounted within the wash tub, and a spraying device positioned above the wash tub. The method includes forming a spraying device having a body including a wall having an outer surface, a water inlet and a channel defined therein, and forming the channel to be in flow communication with the water inlet. The method also includes forming a plurality of nozzles to extend through the wall and be in flow communication with the channel, wherein the nozzles include an inlet, an outlet, an inner diameter and an outer diameter. The method also includes forming the nozzles such that at least a portion of the outlet includes a surface substantially perpendicular to a flow of water through the nozzle, and forming the nozzles such that at least a portion of the outer diameter of the outlet is positioned within an area defined by the wall outer surface.

DETAILED DESCRIPTION OF THE INVENTION

Figure 1:
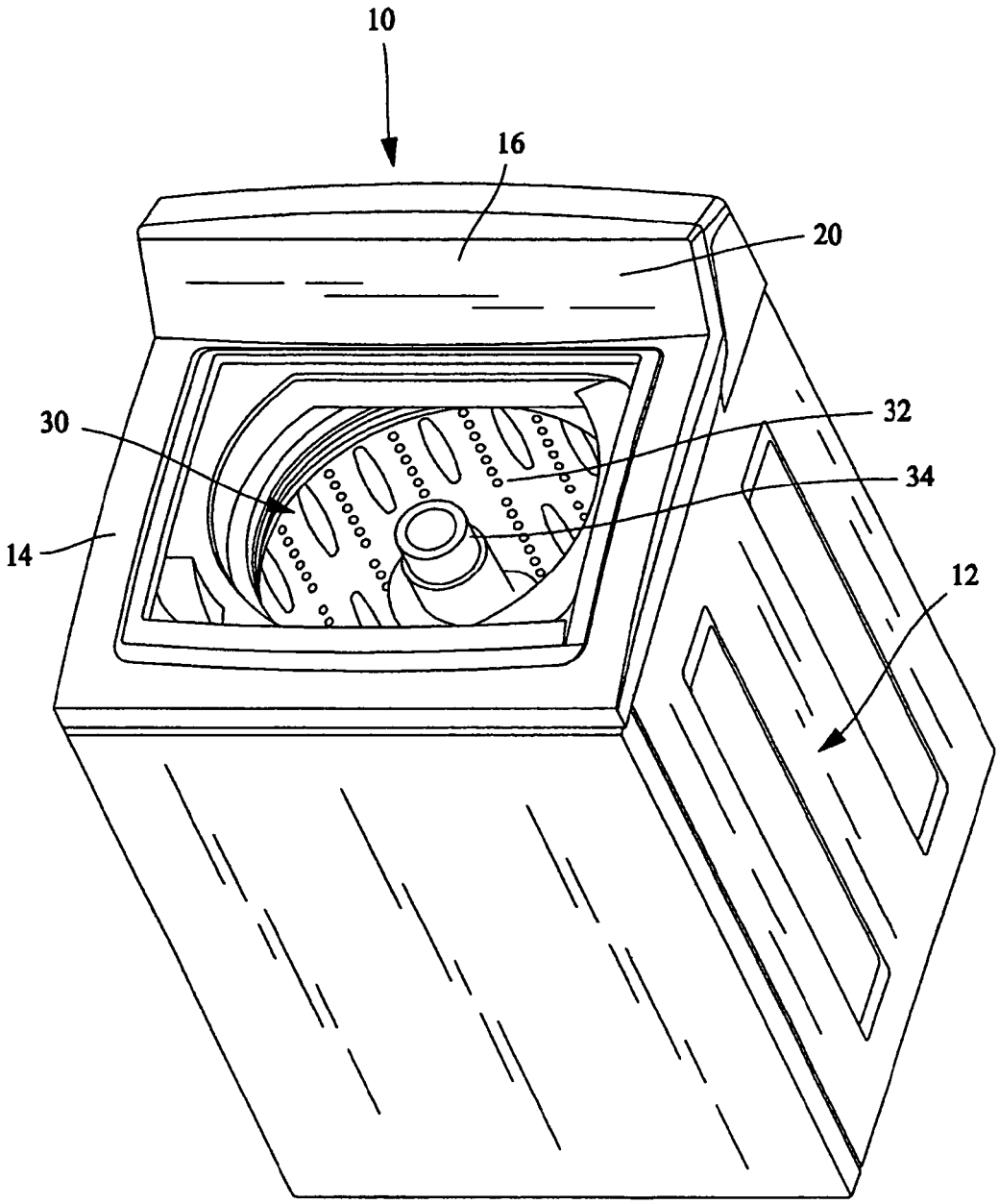
FIG. 1 is a perspective view of an exemplary vertical axis washing machine.

FIG. 1 is a perspective view of an exemplary vertical axis washing machine 10 including a cabinet 12 and a cover 14. A backsplash 16 extends from cover 14, and a variety of appliance control input selectors 20 are coupled to backsplash 16. Input selectors 20 form a user interface input for operator selection of washing cycles and features.

A wash tub 30 is located within cabinet 12, and a wash basket 32 is rotatably mounted within wash tub 30 in a spaced apart relationship from wash tub 30. Basket 32 includes a plurality of perforations therein to facilitate fluid communication between an interior of basket 32 and wash tub 30. A known agitator, impeller, or oscillatory basket mechanism 34 is disposed in basket 32 to impart an oscillatory motion to articles and liquid in basket 32. As illustrated in FIG. 1, agitator 34 is oriented to rotate about a vertical axis. It is contemplated, however, that at least some of the benefits of the present invention may apply to horizontal axis washing machines as well.

Figure 2:
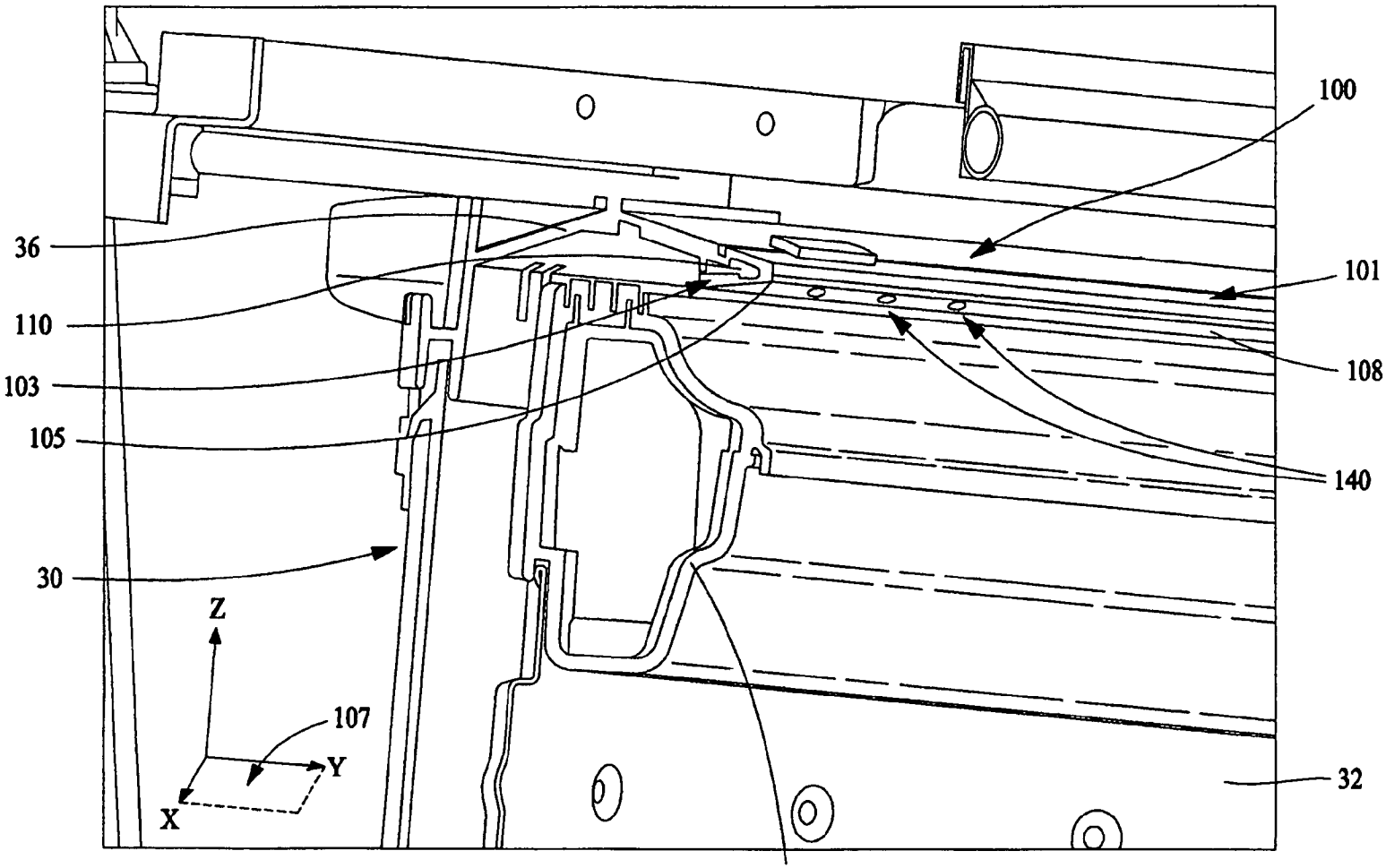
FIG. 2 is a partial and cutaway view of a wash tub applicable to the washing machine shown in FIG. 1.

FIG. 2 is a partial and cutaway view of wash tub 30 applicable to washing machine 10 shown in FIG. 1. Wash tub 30 further includes a tub cover 36 positioned at a top portion of wash tub 30, and a balance ring 38 positioned below tub cover 36 and above basket 32. A spray ring 100, i.e. a spray fill conduit 100 is mounted at the top portion of wash tub 30, and is configured to direct water into wash tub 30. In an exemplary embodiment, spray ring 100 is attached to a lower surface of tub cover 36, such that tub cover 36 facilitates preventing any possible flood condition which may be caused by clothing deflecting water outside wash tub 30. Alternatively, spray ring 100 may also be arranged above tub cover 36.

In the exemplary embodiment, spray ring 100 is substantially triangular in cross section, and includes an upper half 101, a lower half 103, a ring-shaped channel 110 defined along spray ring 100 and surrounded by upper and lower halves 101, 103, and a plurality of nozzles 140 arranged thereon. In an exemplary embodiment, upper and lower halves 101, 103 are jointed together by joining methods for plastic, such as for example, heat bonding, vibration welding or adhesive bonding. In one exemplary embodiment, lower half 103 further includes a slant bottom wall 105 having an outer surface 108, and bottom wall 105 extends at an angle between about 17 and 22 degrees with respect to a horizontal plane 107, which facilitates the even water flow in channel 110 and obtaining a good rinsability (discussed in detail hereinafter).

Figure 3:
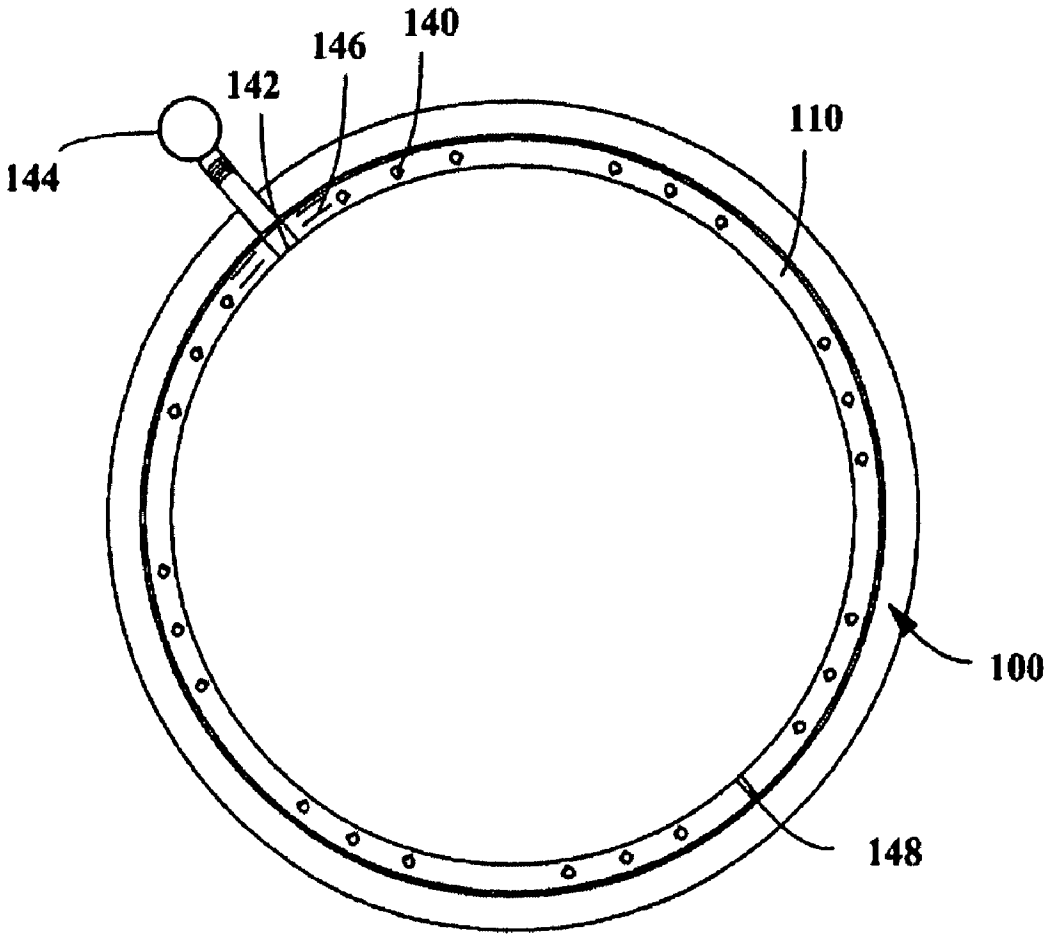
FIG. 3 is a top elevational and cutaway view of a spray ring applicable to the washing machine shown in FIG. 1.

FIG. 3 is a top elevational and cutaway view of spray ring 100 applicable to washing machine 10 shown in FIG. 1. In the exemplary embodiment, spray ring 100 further includes a water inlet 142, and a water valve 144 coupled in flow communication with water inlet 142. Water inlet 142 is in flow communication with channel 110, such that water inlet 142 may direct water into channel 110. In an exemplary embodiment, water valve 144, such as for example, a fixed water valve or a pulsing water valve, is used to control the flow rate in channel 110 within a predetermined range, which facilitates obtaining a good rinsability (discussed in detail hereinafter). Specifically, the flow rate is controlled between approximately 2.5 and 3.5 gallons per minute. It is contemplated, however, that the flow rate range in channel 110 may be varied based on different factors of the washing machine in alternative embodiments.

In the exemplary embodiment, channel 110 further includes two pair of ribs 146 formed on bottom wall 105 (shown in FIG. 2) and positioned within channel 110, and a blocking portion 148 positioned halfway along channel 110. In an exemplary embodiment, each pair of ribs 146 are substantially aligned with the direction of water flow in channel 110 and parallel to each other. Each pair of ribs 146 are positioned between water inlet 142 and a neighboring nozzle 140, and facilitate reducing flow turbulence and obtaining the even water flow within channel 110. Blocking portion 148 prevents water flow therethrough and divides channel 110 into two substantially equal length halves, such that water flows in two directions within channel 110. Blocking portion 148 is positioned farthest with respect to water inlet 142, which facilitates increasing the flow rate of nozzles 140 positioned further away from water inlet 142 to compensate the flow rate decrease and facilitates even flow rate in all nozzles 140 along channel 110.

In the exemplary embodiment, nozzles 140 are arranged in several groups on bottom wall 105 (shown in FIG. 2), and each group is spaced at a predetermined distance with respect to one another, such that nozzle groups are substantially evenly arranged along spray ring 100. In one embodiment, 24 nozzles 140 are arranged in 8 groups, each including 3 nozzles 140 positioned substantially parallel to each other. As such, nozzles 140 of the same group may be manufactured by a single cam (not shown) in molding, which facilitates reducing the cost and components in spray ring manufacture. It is contemplated, however, that the number of nozzles and nozzle groups may be varied in alternative embodiments. It is also contemplated that the pattern of nozzles in each group as well as the pattern of the groups on spray ring 100 may be varied in alternative embodiments.

In the exemplary embodiment, each nozzle 140 also extends in a direction of rotation of basket 32 (shown in FIG. 2), which facilitates preventing nozzles 140 from snagging laundry positioned in rotating basket 32. As such, blocking portion 148 divides nozzles 140 into a first set of nozzles 140 located in a first half of channel 110 and aligned with the water flow direction through the first half, and a second set of nozzles 140 located in a second half of channel 110 and aligned against the water flow direction through the second half.

Figure 4:
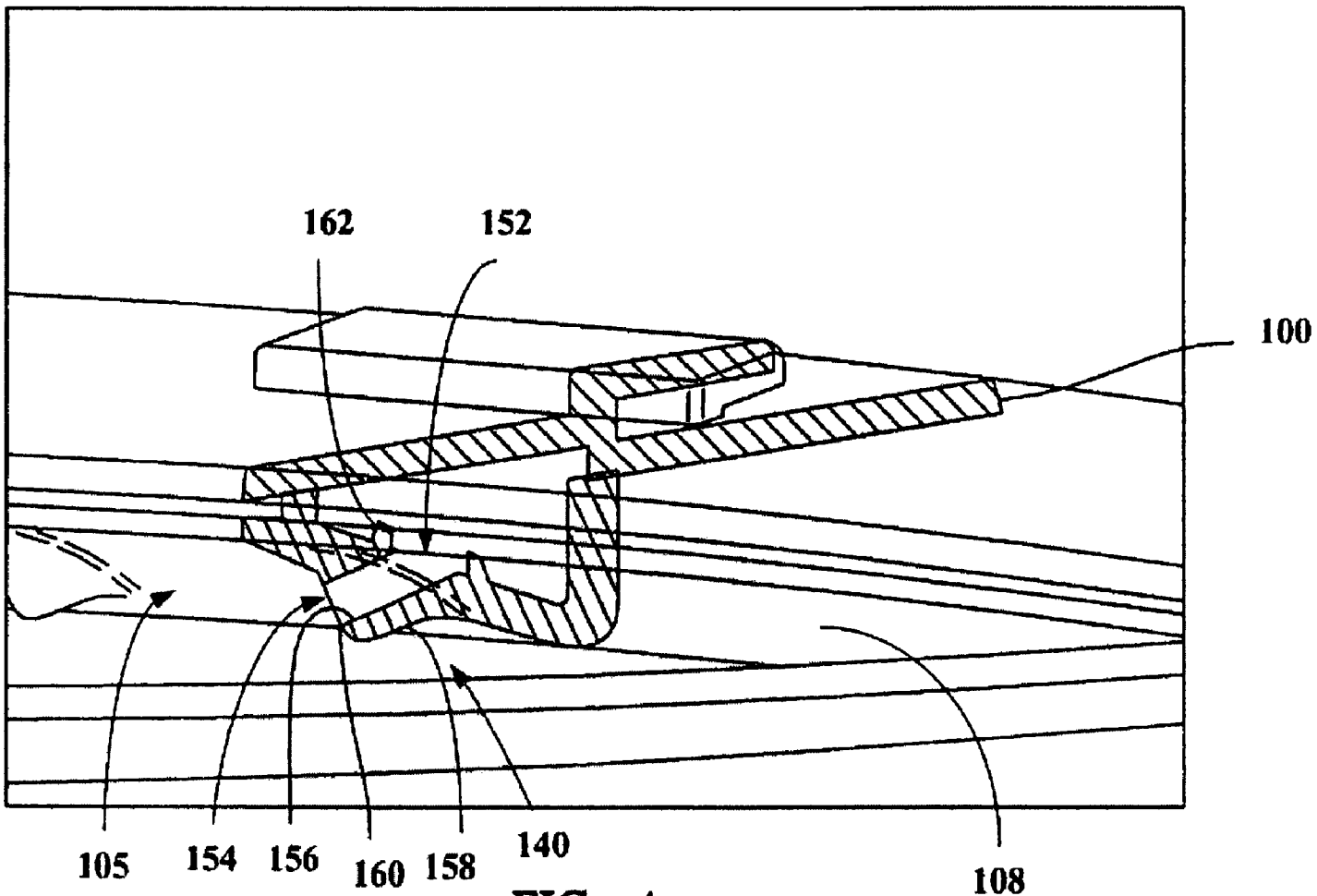
FIG. 4 is a cross-sectional view of a nozzle applicable to the spray ring shown in FIG. 3.
Figure 5:
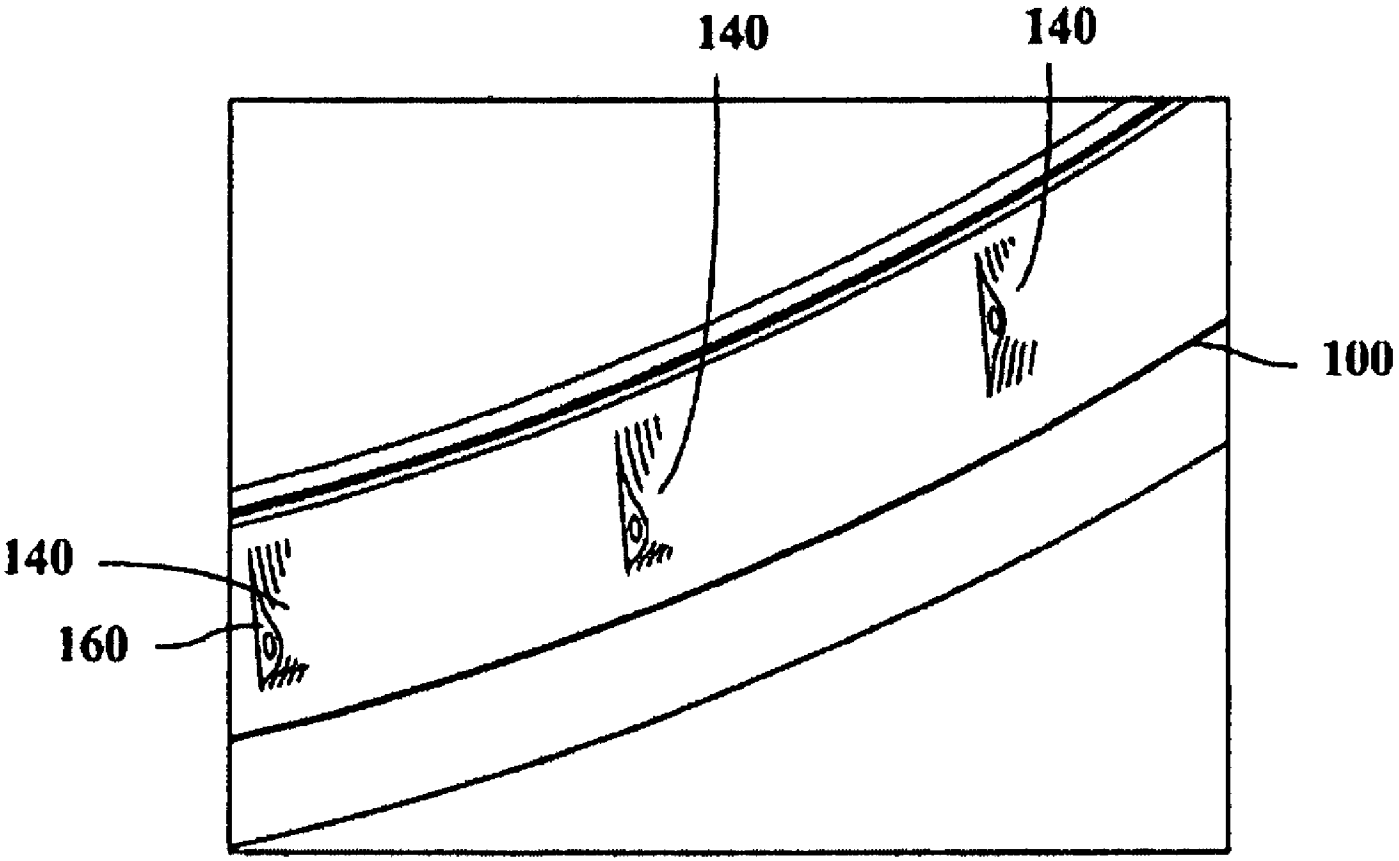
FIG. 5 is a perspective view of the nozzle shown in FIG. 4.

FIG. 4 is a cross-sectional view of nozzle 140 applicable to spray ring 100 shown in FIG. 3, and FIG. 5 is a perspective view of nozzle 140 shown in FIG. 4. In the exemplary embodiment, nozzles 140 extend through bottom wall 105 and extend outward from outer surface 108 of bottom wall 105. As such, nozzles 140 are in flow communication with channel 110, and spray ring 100 is configured to direct water into wash tub 30 (shown in FIG. 2) through nozzles 140.

In the exemplary embodiment, nozzles 140 extend at an angle within a predetermined range with respect to horizontal plane 107 (shown in FIG. 2). Nozzles 140 extending at an angle below the predetermined range may result in water trajectory (shown in FIG. 12) from nozzle 140 being too sensitive to water flow rate, and nozzles 140 extending at an angle beyond the predetermined range may result in relatively high water velocities and water splashing out of wash tub 30 (shown in FIG. 2). Specifically, the angle is between approximately 10 and 45 degrees with respect to horizontal plane 107 (shown in FIG. 2). More specifically, the angle is between approximately 20 and 35 degrees with respect to horizontal plane 107 (shown in FIG. 2). In one embodiment, the angle is approximately 25 degrees with respect to horizontal plane 107. It is contemplated, however, that the predetermined angle range may be varied due to different locations of the spray ring and the different configurations of the washing machine in alternative embodiments.

In the exemplary embodiment, each nozzle 140 has a length longer than the thickness of bottom wall 105, and includes an inlet 152, an outlet 154, an inner diameter 156, and an outer diameter 158. Outlet 154 further includes an end surface 160 substantially perpendicular to a flow of water through outlet 154, which facilitates reducing water sticking onto end surface 160 when water exits from outlet 154. In an exemplary embodiment, end surface 160 is approximately from 85 to 90 degrees with respect to the flow of water through outlet 154. Outlet 154 partially and smoothly submerges into outer surface 108, such that a portion of outlet 154 is positioned within an area defined by outer surface 108 and is unitary with outer surface 108.

In the exemplary embodiment, each nozzle 140 further includes a boss 162 protruding into channel 110 and surrounding inlet 152. In an exemplary embodiment, boss 162 keeps an equal distance with respect to inlet 152, and is elliptical in shape. It is contemplated, however, that the shape and the height of boss 162 may be altered in alternative embodiments. Although the flow rate in nozzles 140 may vary when a first group of nozzles 140 are aligned with the direction of water flow and a second group of nozzles 140 is aligned against the direction of water flow in the corresponding portion of channel 110, boss 162 facilitates reducing such flow rate variation due to different nozzle alignments with respect to the channel flow direction.

Figure 6:
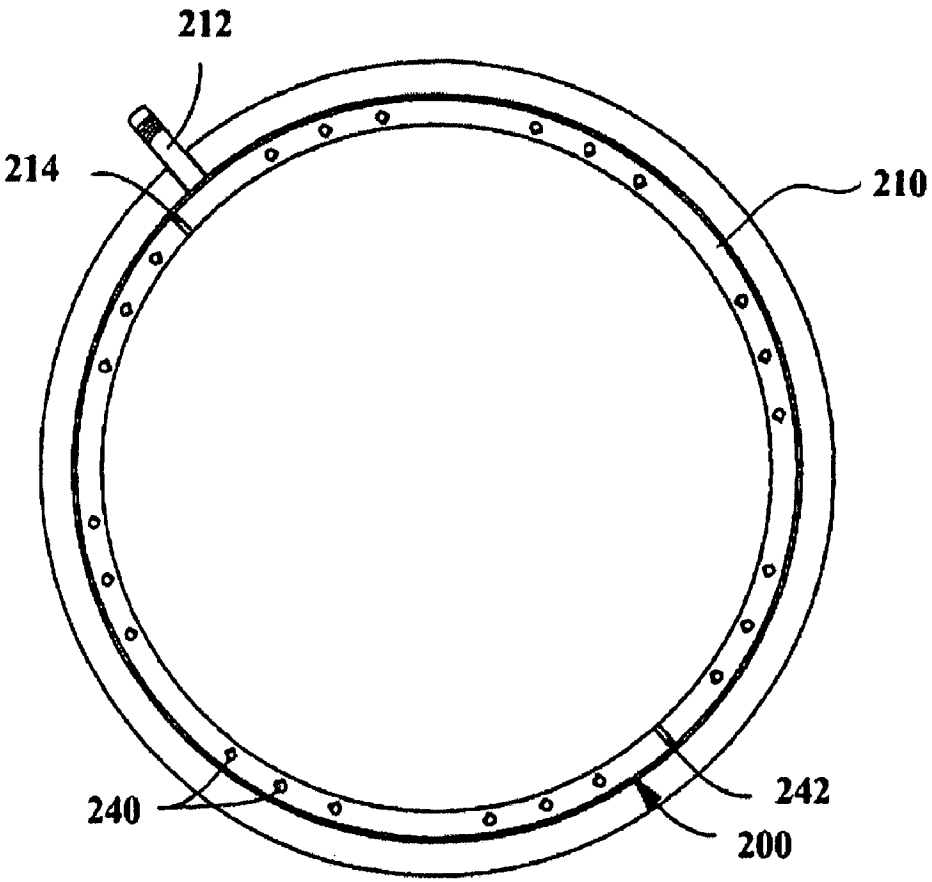
FIG. 6 is a top elevational and cutaway view of an alternative spray ring applicable to the washing machine shown in FIG. 1.
Figure 7:
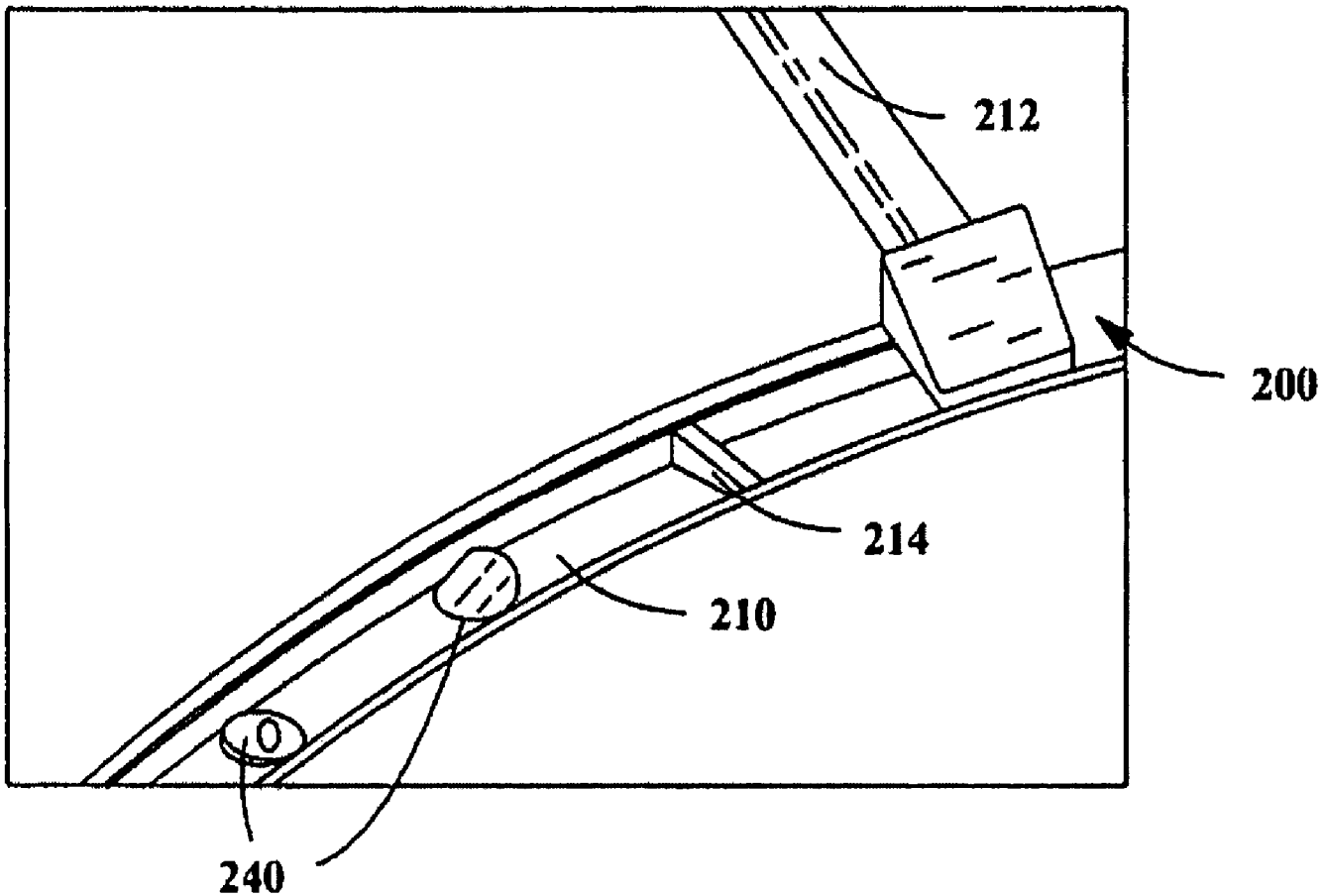
FIG. 7 is an enlarged cutaway view of the spray ring shown in FIG. 6.

FIG. 6 is a top elevational and cutaway view of an alternative spray ring 200 applicable to washing machine 10 shown in FIG. 1, and FIG. 7 is an enlarged cutaway view of spray ring 200 shown in FIG. 6. In the exemplary embodiment, spray ring 200 includes a ring-shaped channel 210 defined therein, a water inlet 212 in flow communication with channel 210, a baffle 214 positioned adjacent water inlet 212, and a plurality of nozzles 240 arranged thereon.

In an exemplary embodiment, water flows in two directions in channel 210, such that nozzles 240 are divided into a first set of nozzles 240 aligned with the direction of water flow in the corresponding portion of channel 210 and a second set of nozzles 240 aligned against the direction of water flow in the corresponding portion. As such, the flow rate in the first set of nozzles 240 may be greater than that of second set of nozzles 240.

In the exemplary embodiment, baffle 214 is positioned substantially halfway between water inlet 212 and a neighboring nozzle 240, and partially blocks channel 210 to reduce water flow toward the first set of nozzles 240 which originally has a higher flow rate therein. Specifically, baffle 214 reduces the cross sectional area of channel 210 by approximately 25% to 40%. More specifically, baffle 214 reduces the cross section area of channel 210 by approximately 40%. As such, baffle 214 reduces the water flow through the first set of nozzles 240, and facilitates realizing an even flow of water in all nozzles 240 around channel 210.

In an exemplary embodiment, channel 210 further includes a blocking portion 242 positioned halfway along channel 210 and corresponding to water inlet 212. Blocking portion 242 partially blocks channel 210. Specifically, blocking portion 242 blocks approximately 80% of the cross sectional area of channel 210. It is contemplated, however, that blocking portion 242 may be removed from channel 210 in alternative embodiments or blocking portion 242 may block the entire cross sectional area of channel 210.

Figure 8:
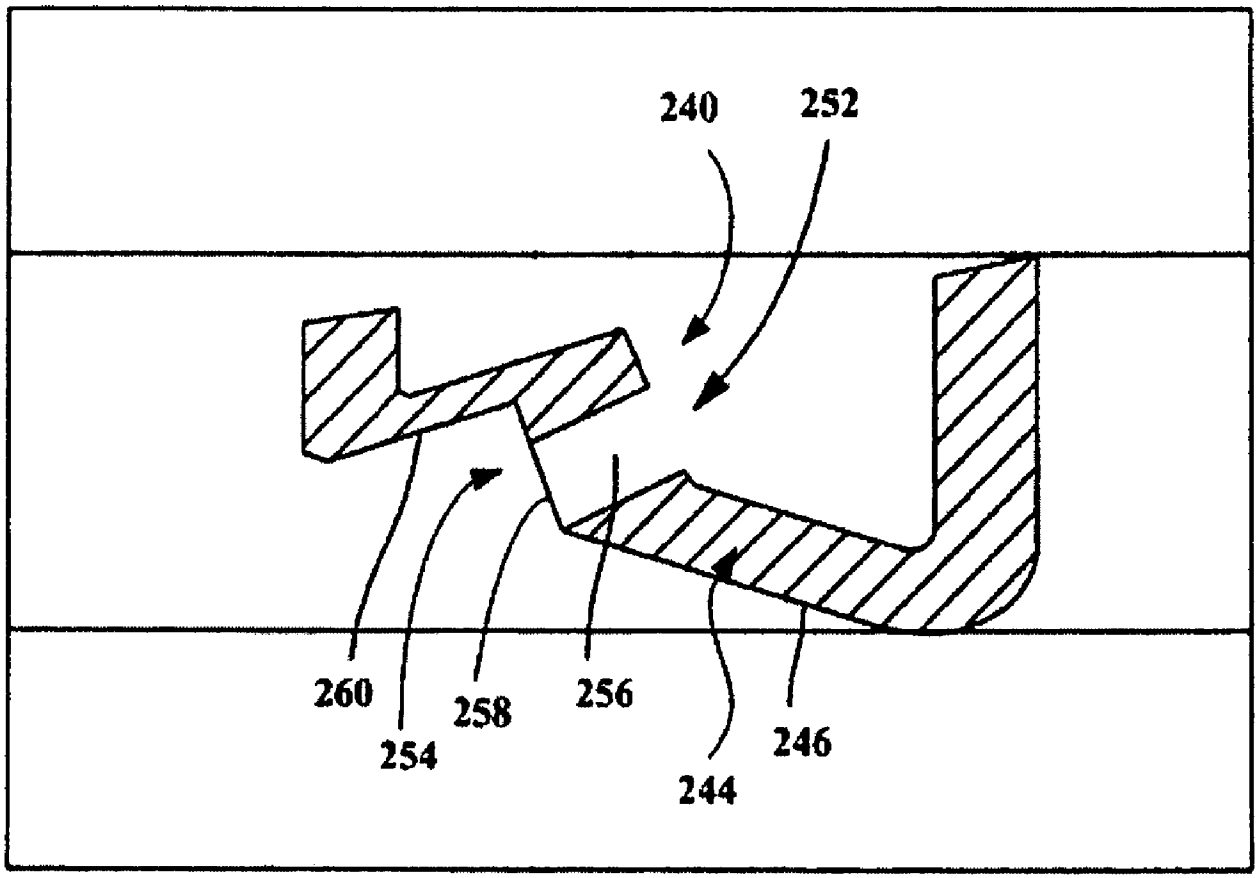
FIG. 8 is a cross-sectional view of a nozzle applicable to the spray ring shown in FIG. 6.
Figure 9:
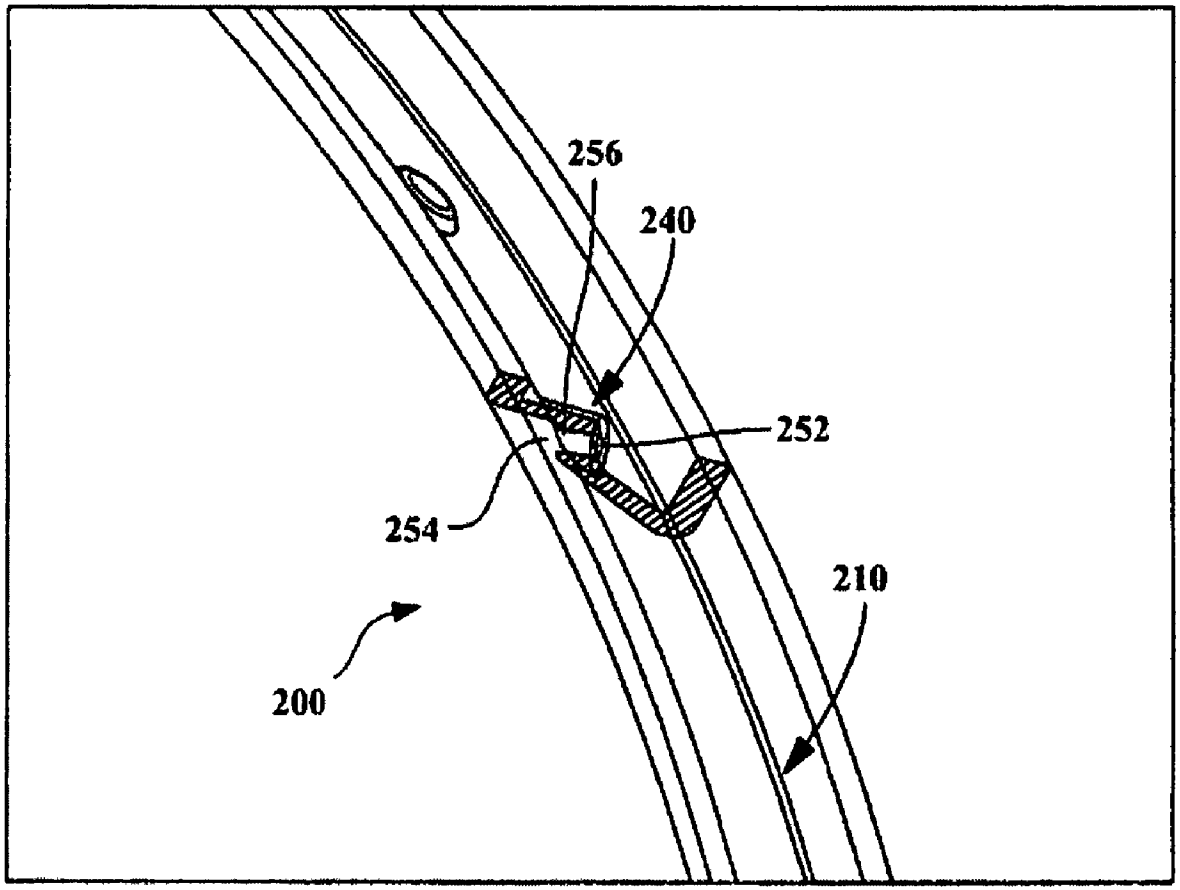
FIG. 9 is a perspective view of the nozzle shown in FIG. 8.

FIG. 8 is a cross-sectional view of nozzle 240 applicable to spray ring 200 shown in FIG. 6, and FIG. 9 is a perspective view of nozzle 240 shown in FIG. 8. Spray ring 200 also includes a bottom wall 244 having an outer surface 246, and a plurality of nozzles 240 extending through bottom wall 244 and extending into channel 210.

In the exemplary embodiment, each nozzle 240 also has a length longer than the thickness of bottom wall 244, and includes an inlet 252, an outlet 254, and a nozzle channel 256 extending therebetween. A portion of outlet 254 further includes an end surface 258 substantially perpendicular to a flow of water through outlet 254, which facilitates reducing water sticking onto end surface 258 when water exits from outlet 254. End surface 258 is recessed with respect to outer surface 246, and each nozzle 240 further includes a partially cylindrical cutout 260 defined on outer surface 246 and partially surrounding end surface 258. In an exemplary embodiment, cutout 260 has a diameter at least 0.1 inch greater than the diameter of nozzle channel 256, which facilitates preventing water collecting in cutout 260 and sticking on outer surface 246.

In one embodiment, at least some nozzles 240 further include a baffle (not shown) positioned within nozzle channel 256 in lieu of baffle 214 (shown in FIG. 7) positioned within channel 210. Specifically, the nozzle baffle is positioned in nozzle channel 256 of each of the first set of nozzles 240 which are aligned with the water flow direction, such that the nozzle baffle reduces water flow through the first set of nozzles 240 compared to the second set of nozzles 240 for obtaining an even flow rate in all nozzles 240 around channel 210. In one embodiment, each nozzle 240 further includes a boss (not shown) having a similar configuration as boss 162 (shown in FIG. 4) and surrounding inlet 252.

Figure 10:
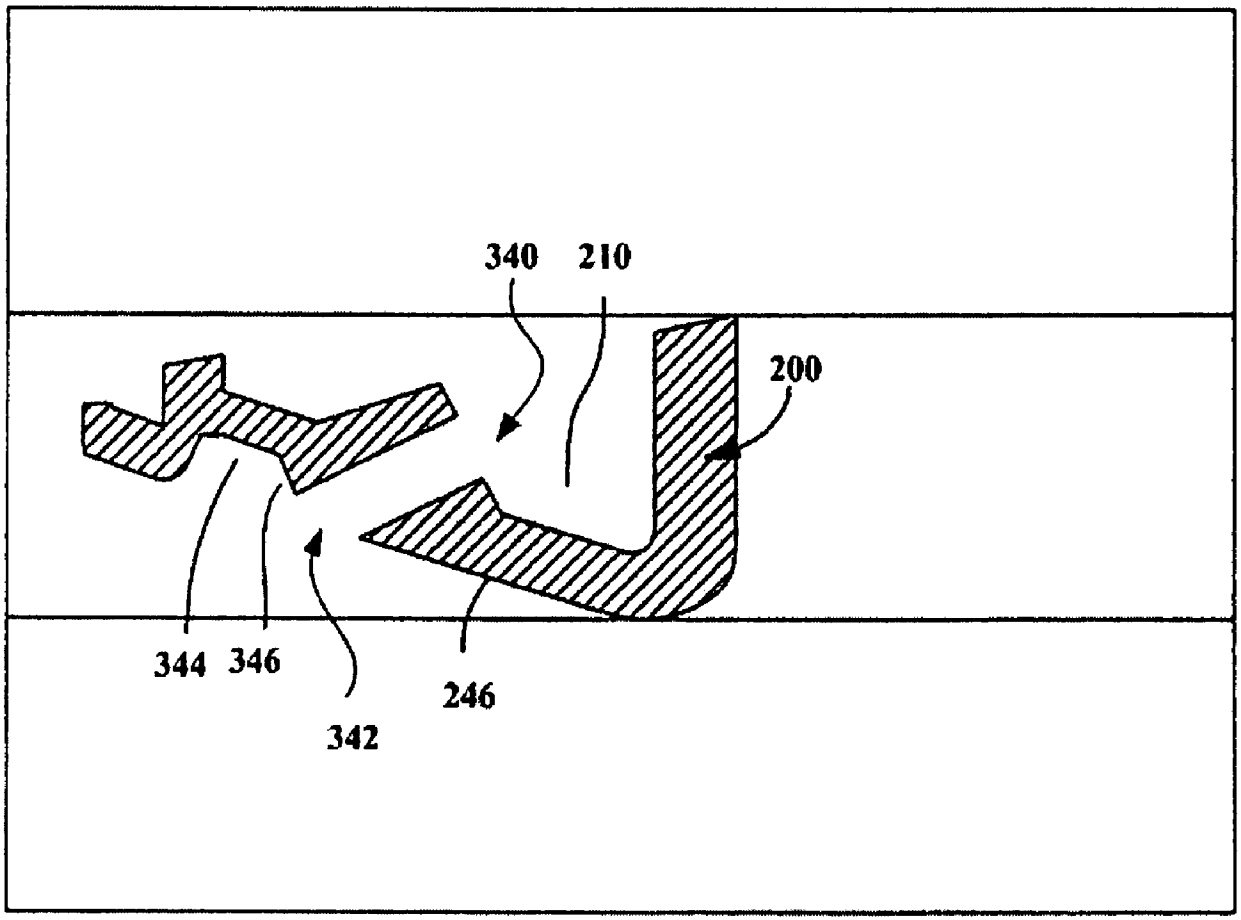
FIG. 10 is a cross-sectional view of an alternative nozzle applicable to the spray ring shown in FIG. 6.

FIG. 10 is a cross-sectional view of an alternative nozzle 340 applicable to spray ring 200 shown in FIG. 6. Nozzle 340 is similar to nozzle 240 (shown in FIG. 8), and includes an outlet 342 partially recessed with respect to outer surface 246, and a recess 344 defined on outer surface 246 and adjacent outlet 342. A portion of outlet 342 also includes an end surface 346 substantially perpendicular to a flow of water through outlet 342. Recess 344 is positioned adjacent end surface 346, and cooperates with end surface 346 to facilitate minimizing water channeling outward from outlet 342 sticking onto outer surface 246.

In one embodiment, nozzles 240, 340 (shown in FIGS. 8, 10) are employed on spraying ring 100 (shown in FIG. 3) to obtain at least some of the benefits of the present invention. In another embodiment, nozzles 140 (shown in FIG. 4) are employed on spray ring 200 (shown in FIG. 6).

Figure 11:
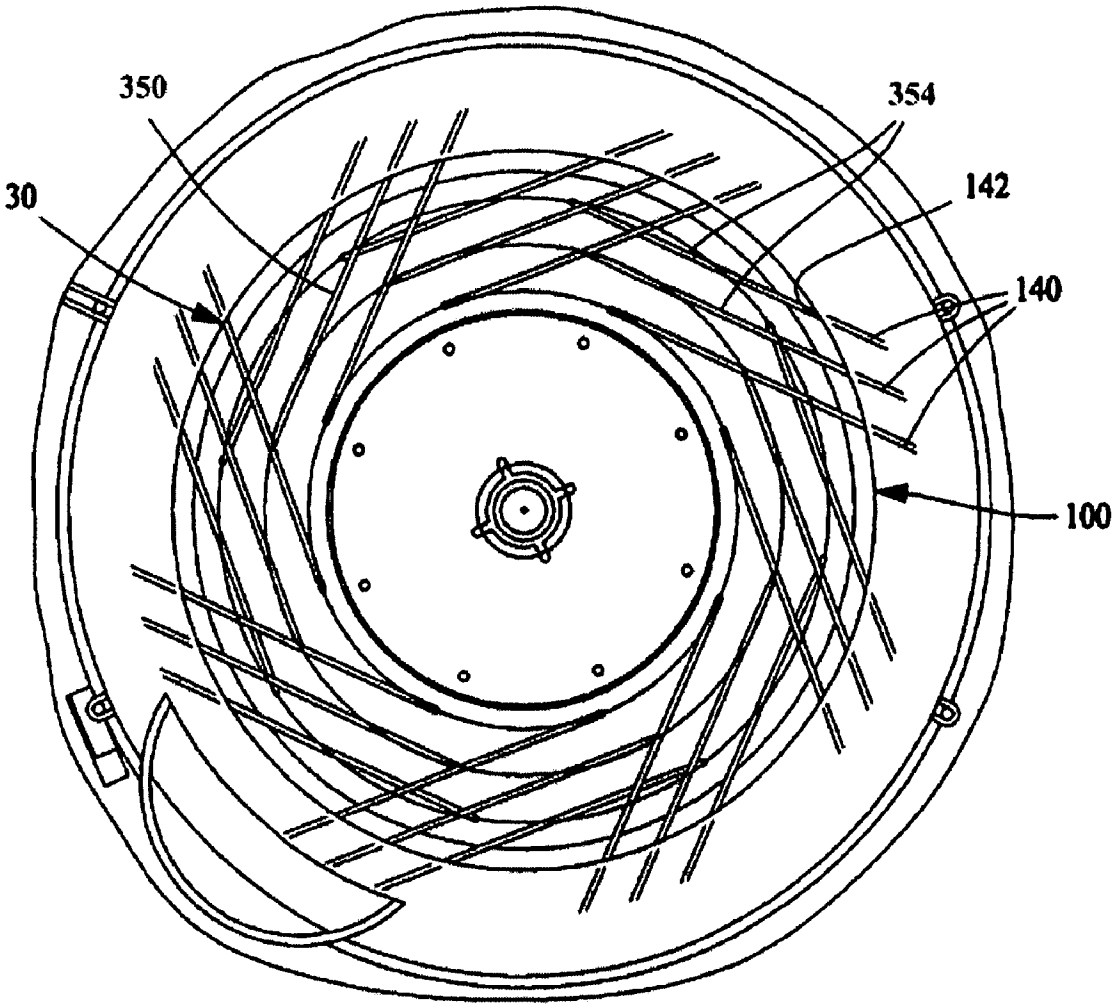
FIG. 11 is a top elevational view of the washing machine shown in FIG. 1.
Figure 12:
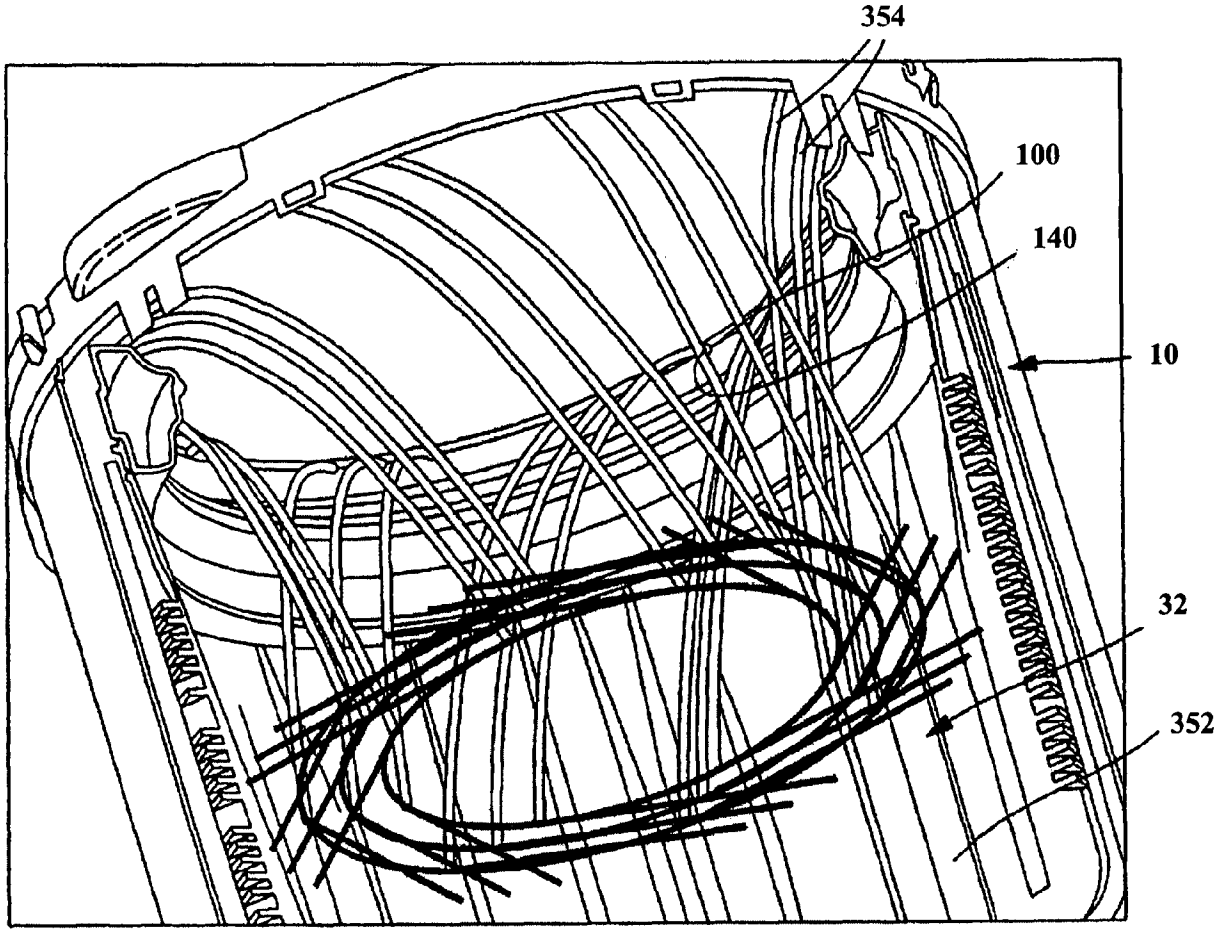
FIG. 12 is a perspective cutaway view of the washing machine shown in FIG. 1.

FIG. 11 is a top elevational view of spray ring 100 shown in FIG. 4 mounted on washing machine 10 shown in FIG. 1, and FIG. 12 is a perspective cutaway view of spray ring 100 mounted on washing machine 10. Alternatively, spray ring 200 is employed on washing machine 10 to obtain a similar rinsability in other embodiments.

In a rinse cycle of the washing operation, nozzles 140 channel water into wash tub 30 in a non-overlapping manner and in a non-radial direction with respect to wash tub 30. In an exemplary embodiment, nozzles 140 direct water outward from outlet 154 at an angle between approximately 35 and 50 degrees with respect to outer surface 108 (shown in FIG. 2) and to a predetermined location. Specifically, nozzles 140 direct water outward from outlet 154 at an angle between approximately 39 and 45 degrees with respect to outer surface 108. Each nozzle 140 channels water to a location within a space approximately 10 inches upward from a bottom wall 350 of basket 32 and approximately 4 inches inward from a sidewall 352 of basket 32. The space is generally the location of the laundry after wash spin is completed, such that water directed by each nozzle 140 impinges on the laundry to facilitate a good rinse and avoid water waste. Each nozzle 140 directs water forming a trajectory 354. Trajectories 354 of nozzles 140 of the same group are substantially parallel with each other.

The nozzle has a length greater than the side wall of the spray ring, which facilitates more accurately directing water to the predetermined location. The water valve controls the flow rate in the channel within a predetermined range, the ribs, the blocking portion, and the baffle also facilitate the even flow rate in each nozzle to avoid wasting water.

The methods and apparatus described herein facilitate rinsing the laundry using less water than is required in a known washing machine. Specifically, the spray nozzles described herein facilitate directing an increased quantity of water to the laundry while reducing a quantity of water wasted compared to known washing machines. Accordingly, the methods and apparatus described herein facilitate providing clean clothes while substantially reducing a quantity of water consumed to clean the clothes compared to known washing machines. Additionally, the apparatus described herein facilitates avoiding a re-circulating rinse water configuration, a considerable amount of additional materials and assemblies are saved, such that the present invention obtains good rinsing with low water consumption and low manufacturing cost.

While the invention has been described in terms of various specific embodiments, those skilled in the art will recognize that the invention can be practiced with modification within the spirit and scope of the claims.

What is claimed is:

1. A spraying device for a washing machine including a wash tub and a basket mounted within the wash tub, the basket configured to rotate, said spraying device comprising:

a body mounted to the wash tub, said body comprising a wall having an outer surface, a water inlet and an annular channel defined therein, said channel in flow communication with said water inlet;

a plurality of first nozzles defined within a first portion of said body, each first nozzle of said plurality of first nozzles defining an inlet and an outlet and extending through said wall in flow communication with said channel, at least a portion of each first nozzle unitary with said outer surface, said plurality of first nozzles configured to direct water in a first direction of flow through said channel with respect to a circumference of the wash tub; and a plurality of second nozzles defined within a second portion of said body, each second nozzle of said plurality of second nozzles defining an inlet and an outlet and extending through said wall in flow communication with said channel, at least a portion of each second nozzle unitary with said outer surface, said plurality of second nozzles configured to direct water in a second direction of flow through said channel with respect to the circumference of the wash tub opposite the first direction of flow, each first nozzle and each second nozzle comprising a boss protruding into said channel and surrounding said inlet to facilitate reducing a variation in water flow in said channel due to different alignments of said plurality of first nozzles and said plurality of second nozzles with respect to the first direction of flow.

2. A spraying device in accordance with claim 1 wherein said body further comprises a pair of parallel ribs formed on an inner surface of said wall in said channel, said ribs configured to facilitate reducing flow turbulence within said channel.

3. A spraying device in accordance with claim 1 wherein said body further comprises a blocking portion within said channel to prevent water flow therethrough.

4. A spraying device in accordance with claim 1 wherein said spraying device further comprises a baffle configured to reduce water flow through at least one said nozzle.

5. A spraying device in accordance with claim 1 wherein water exits said outlet at an angle between 35 degrees and 50 degrees with respect to said outer surface.

6. A washing machine comprising:

a cabinet;

a wash tub positioned within said cabinet;

a basket rotatably mounted within said wash tub; and a spraying device positioned within said cabinet and above said wash tub, said spraying device comprising:

a body comprising a wall having an outer surface, a water inlet and an annular channel defined therein, said channel in flow communication with said water inlet;

a plurality of first nozzles defined within a first portion of said body, each first nozzle of said plurality of first nozzles defining an inlet and an outlet and extending through said wall in flow communication with said channel, at least a portion of each first nozzle unitary with said outer surface, said plurality of first nozzles configured to direct water in a first direction of flow through said channel with respect to a circumference of the wash tub; and a plurality of second nozzles defined within a second portion of said body, each second nozzle of said plurality of second nozzles defining an inlet and an outlet and extending through said wall in flow communication with said channel, at least a portion of each second nozzle unitary with said outer surface, said plurality of second nozzles configured to direct water in a second direction of flow through said channel with respect to the circumference of the wash tub opposite the first direction of flow, each first nozzle and each second nozzle comprising a boss protruding into said channel and surrounding said inlet to facilitate reducing a variation in water flow in said channel due to different alignments of said plurality of first nozzles and said plurality of second nozzles with respect to the first direction of flow.

7. A washing machine in accordance with claim 6 wherein each said first nozzle has a length greater than a width of said wall.

8. A washing machine in accordance with claim 6 wherein said body further comprises a pair of parallel ribs formed on an inner surface of said wall in said channel, said ribs configured to facilitate reducing flow turbulence within said channel.

9. A washing machine in accordance with claim 6 wherein said body further comprises a blocking portion within said channel configured to prevent water flow therethrough.

10. A washing machine in accordance with claim 6 wherein said nozzles further comprise a baffle extending within said inner diameter.

11. A washing machine in accordance with claim 6 wherein water exits said outlet at an angle between 35 degrees and 50 degrees with respect to said outer surface.

12. A washing machine in accordance with claim 6 wherein each said nozzle configured to minimize water sticking to said outer surface and said nozzle outlet surface.

* * * * *